United States Patent [19]

Bryan

[11] 4,014,081

[45] Mar. 29, 1977

[54] METHOD FOR PROCESSING OF SWEATER SECTIONS AND THE LIKE

[75] Inventor: Clifford Chandler Bryan, Statesville, N.C.

[73] Assignee: Samcoe Holding Corporation, Woodside, N.Y.

[22] Filed: July 10, 1975

[21] Appl. No.: 594,742

Related U.S. Application Data

[63] Continuation-in-part of Ser. No. 488,672, July 15, 1974, abandoned.

[52] U.S. Cl. ..... 26/18.5; 26/84

[51] Int. Cl.[2] ..... D06C 5/00; D06C 27/00

[58] Field of Search ..... 26/18.5, 55 R, 56, 84

[56] References Cited

UNITED STATES PATENTS

| | | | |
|---|---|---|---|
| 1,804,097 | 5/1931 | Hahn | 26/18.5 UX |
| 2,494,808 | 1/1950 | Haeberlin | 26/18.5 |
| 2,588,624 | 3/1952 | Evans | 26/56 X |
| 2,944,317 | 7/1960 | Cohn et al. | 26/55 R X |
| 3,044,142 | 7/1962 | Brunner | 26/55 R X |
| 3,090,666 | 5/1963 | Jones | 26/18.5 X |
| 3,098,279 | 7/1963 | Brunner | 26/18.5 |
| 3,484,949 | 12/1969 | Aronoff | 26/55 R UX |
| 3,585,696 | 6/1971 | Aronoff | 26/18.5 |

FOREIGN PATENTS OR APPLICATIONS

| | | | |
|---|---|---|---|
| 203,764 | 9/1923 | United Kingdom | 26/56 |

*Primary Examiner*—Robert R. Mackey
*Attorney, Agent, or Firm*—Mandeville and Schweitzer

[57] ABSTRACT

Knitted tubular sweater sections, including a body section and a relatively elastic cuff section, are applied in succession to a spreading frame and are distended to a predetermined, uniform width throughout. The distended sweater sections are then discharged from the spreader frame into a processing section, including a pair of opposed conveyor blankets. In a controlled space interval, between the end of the spreading frame and the line of engagement of the sweater section by the opposed conveyor blankets, controllable width contraction of the sweater section is caused or permitted to occur.

Immediately thereafter, the fabric section is engaged by the opposed conveyor blankets, which grip and confine the fabric section lightly over substantially its entire surface area to retain the geometry of the fabric. While thus gripped and confined, the fabric section is steamed, conveyed for a short distance further between the conveyor blankets, and then released. Excess moisture is extracted from the conveyor blankets in order to assure that the unprocessed sweater sections are maintained free of external moisture prior to completion of the distending-contracting-sequence. Provision may be made for vertically displacing the fabrics while they contain added moisture from steaming, momentarily to free them from the conveyor blanket and thereby to achieve full relaxation and geometric adjustment of the fabrics, and a fluffy appearance.

12 Claims, 2 Drawing Figures

METHOD FOR PROCESSING OF SWEATER SECTIONS AND THE LIKE

RELATED APPLICATIONS

This application is a continuation-in-part of my copending application Ser. No. 488,672, filed July 15, 1974, now abandoned.

BACKGROUND AND SUMMARY OF THE INVENTION

In the commercial manufacture of knitted sweaters, it is conventional to construct a complete sweater by assembling a plurality of separate, individually produced sections. Typically, sweater body sections may be knitted on a circular knitting machine in a manner to form a body portion of a first type of stitch, and an elastic waistband or cuff portion of a second type of stitch. The cuff portion is constructed to have greater elasticity than the body portion and is intended, in the finished sweater, to have a relatively restricted circumference measurement, as compared to the body portion. In the continuous production of such sweater sections, individual sections are connected together by removable draw threads. Typically, after preliminary processing of the connected-together sweater sections, the draw threads will be romoved, and the final processing of the sections continues on an individual basis.

In the final processing of the sweater sections, prior to being laid up and cut to shape, and then sewed together with other sweater body parts, the sections are blocked or shaped by application over a shaping frame, followed by steaming. This framing and steaming operation is, in practice, carried out substantially as a hand operation, on a one at a time basis. Illustrative of the type of apparatus which can be used in such an operation, is the Cerami U.S. Pat. No. 3,118,579, for example. In a conventional framing and steaming operation, the body portion of the sweater section is slipped over framing elements which are set at a predetermined width. The cuff portion of the sweater either remains off of the spreader frame or, in some cases, is applied over a section of the frame having a substantially reduced width. While held on the frame, the body portion of the sweater is steamed momentarily. The sweater section remains on the frame briefly, after steaming, and then is withdrawn.

As will be appreciated, the conventional framing and steaming operation is relatively time consuming and laborious. In addition, processing results are far from being uniform, because timing of the operations is difficult to control effectively, and is therefore typically left up to the operator's judgment.

One advantageous procedure for processing sweater sections on a substantially automatic basis is reflected in the S. Cohn et al U.S. Pat. No. 2,944,317, in which connected-together sweater sections are passed over a distending frame and selectively steamed. Steam is thus applied to the body portion of the sweater section but is abruptly cut off as the cuff portion passes through the steaming area. The procedure of this patent greatly increased the rate of production in the framing and steaming operation and provides important advantages in the production of relatively nonsensitive fabrics.

The procedure of the present invention represents a further important improvement over prior art techniques, in providing for the processing of all types of fabrics, even those which are sensitive to pressure marking, and also in providing for a "flow-through" processing of the separated and individual sweater sections in a highly uniform manner.

A significant feature of the present invention resides in the fact that sweater sections and other so-called transfer fabrics, including portions of dissimilar construction and elasticity, are conveyed over a distending frame while in a substantially dry condition. Desirably, the amount of lateral distension imparted to the sweater sections is such as to bring the body portions of the sections to the desired width. The more elastic cuff portion of the sweater section is also distended to the same width as the body portion, in passing over the spreading frame, but it is intended that the cuff will return to a substantially narrower dimension.

In accordance with the invention, the substantially dry sweater sections, after discharge from the distending frame, are engaged substantially across the full width thereof by a pair of opposed conveyor blankets. These blankets are guided in such manner that each sweater section is relatively unconfined fro a short interval after its discharge from the spreading frame and prior to its engagement by the conveyor blankets. In this interval, which is controllably adjustable, the body portion of the sweater section assumes its desired width and the cuff section returns to a desired, narrower width. With the sweater section thus shaped, it is gripped lightly by the conveyor blankets, and while so gripped, is exposed to steam. Unlike conventional procedures, in the new process the steam is applied to both the body and cuff portions of the sweater section, and not to just the body portion alone.

After steaming, the sweater section is conveyed a short distance further by the opposed blankets, and then released. Suction means is provided to extract excess moisture from the faric before its discharge from the processing station. In addition, condensed moisture is extracted from the conveyor blankets themselves, so that the fabric sections being discharged by the spreading frame are not affected by external moisture carried by the conveyor blankets.

In the process of the invention, individual sweater sections, which are originally connected together by removable draw threads, have been previously separated and are processed on an individual basis. Thus, although successive sweater sections may be fed into a processing machine in close, rapid succession, physical separation of one section from another is important to accommodate proper contraction of a cuff portion of one section without affecting the geometry of the body portion of an adjacent sweater section.

In order to achieve optimum readjustment and relaxation of the sweater sections after steaming, the sections are released from the grip of opposed conveyors and are conveyed on the lower blanket only. While the sweater blank is being thus conveyed, the conveyor blanket is subjected to vigorous agitation of substantial vertical amplitude, sufficient to literally lift the sweater material off of the conveyor blanket. The fabric is thereby enabled to relax free of restraint by the surface of the conveyor blanket. The relaxation phase desirably is carried out closely following the steaming and before vacuum extraction of the fabric.

For a better understanding of the above and other features and advantages of the invention, reference should be made to the following detailed description, and the accompanying drawings.

DESCRIPTION OF A PREFERRED EMBODIMENT

Figure 1:
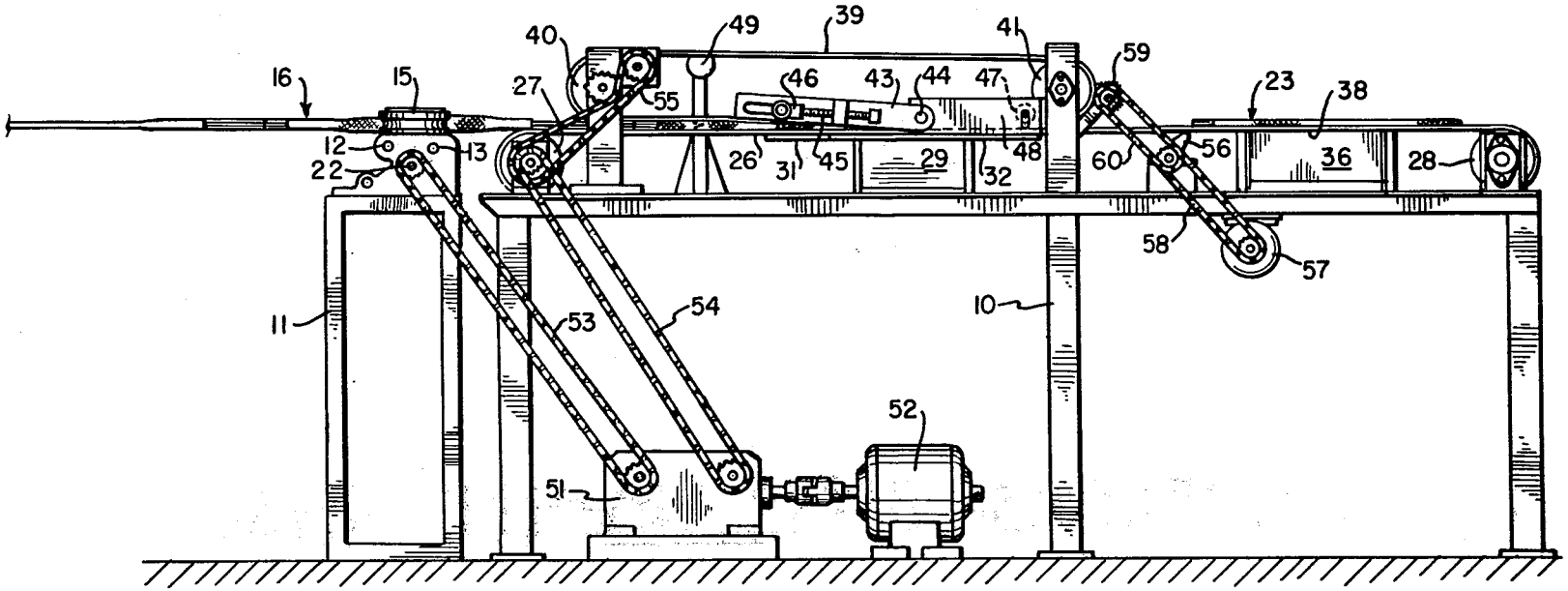
FIG. 1 is a side elevational view of an apparatus suitable for carrying out the process of the invention.

Referring now to the drawings, the reference numerals 10, 11 designate a suitable frame structure, on which the operating elements of the equipment are supported at a convenient level. The frame 11 supports a pair of transversely disposed guide rods 12, 13 on which are supported a pair of carriages 14. The carriages 14 rotatably support a pair of edge drive rolls 15 which cooperate in a known manner with a spreader frame, generally designated by the reference numeral 16 which may be of a conventional type. The spreader frame is provided with appropriate adjustable transverse supports 19, 20 for setting the spreader belts to desired width. The edge drive roll carriages 14 are adjustably positioned on the guide rods 12, 13 by means of a threaded shaft 21. A suitable splined drive shaft 22 rotates the edge drive rolls 15 in any adjusted position of the carriages 14.

To particular advantage, the process of the invention inccorporates a propeller-spreader 16 having a single pair of propelling belts for conveying the fabric sections without interruption from the upstream section 17, through the region of the edge drive rolls 15, and along the downstream section 18. So-called dual or two-stage belt spreaders, having separate pairs of upstream and downstream belts, are less advantageous when processing a multitude of disconnected individual items because each item presents a free leading edge and it is possible to lose control over a leading edge as it is transferred from one belt stage to another, unless special precautions are taken.

The spreader frame 16, a well known and widely used piece of equipment in the processing of tubular knitted fabrics, is arranged to receive individual sweater sections 22 at the upstream end of the spreader and by motion of the belts 17–18 to advance the sweater sections longitudinally along the full length of the spreader frame, discharging the sweater sections at the downstream or discharge end. Typically, the upstream portion 17 of the belts are divergently related, to cause the fabric sections to be distended in circumference. The downstream portions 18 desirably are substantially parallel.

Figure 2:
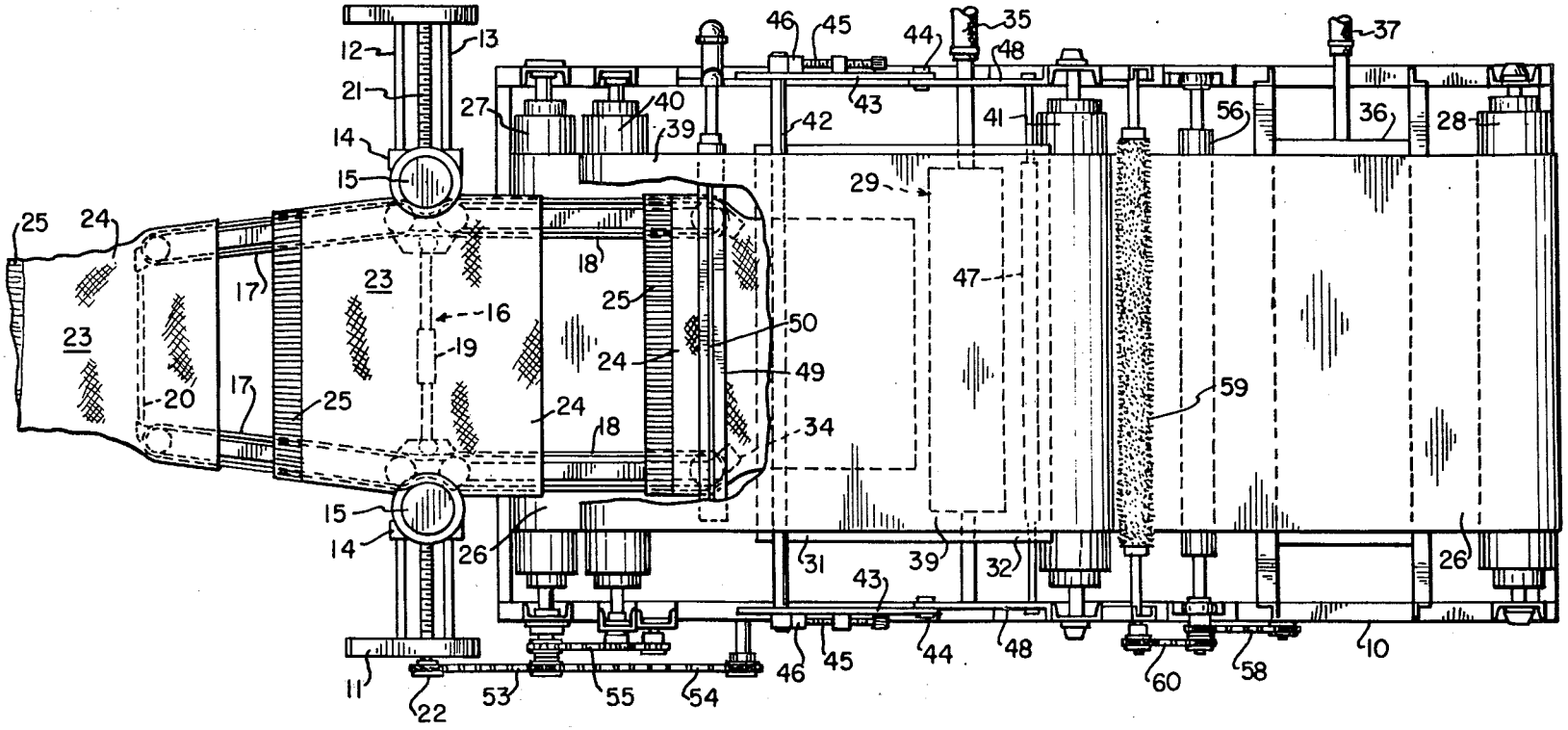
FIG. 2 is a top plan view of the apparatus and of FIG. 1.

As reflected particularly in FIG. 2, the sweater sections 23 include body portions 24 and waistband or cuff portions 25. Conventionally, although the body and cuff portions 24, 25 are integrally knitted in a continuous operation, the stitch structure of the cuff portion is substantially different from that of the body portion, providing a greater contractibility and also a smaller nominal circumference in the cuff, as is well known. In addition, although the sweater sections 23 are knitted in a countinuous series of connected-together sections, the present invention contemplates that the original, knitted sections will be sparated prior to processing. Advantageous techniques for effecting this separation are described in the U.S. Pat. No. 3,797,080.

In accordance with the invention, the sweater sections 23, when applied to the spreader frame 16, are in a substantially dry state. By "substantially dry" it is meant that the sweater sections may contain a normal percentage of moisture content that the yarns will acquire by exposure to normal atmospheric conditions, but the sections must be free of any substantial amount of externally applied moisture, such as from a prior wet processing operation, or special steaming operation. In addition, it is a significant feature of the invention that the sweater sections shall remain in their substantially dry condition at all times while engaged by the spreader. This does not, of course, preclude the application of steam to the discharged leading end of a sweater section, while the trailing end remains on the spreader, but it does preclude the application of steam or other external moisture to any portion of the sweater section which still remains on the spreader frame.

Figure 3:
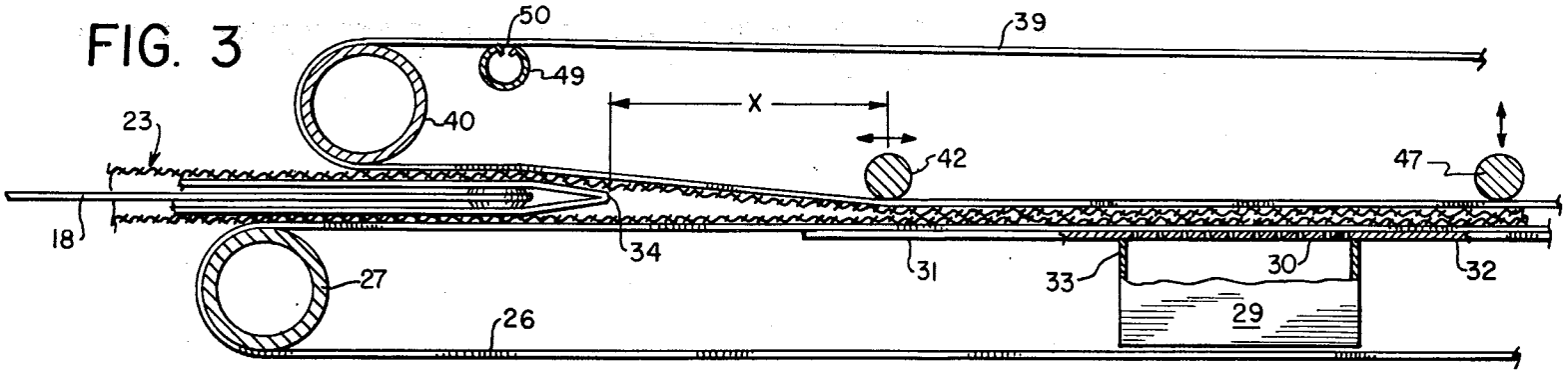
FIG. 3 is an enlarged fragmentary cross-sectional view as taken generally on line 3—3 of FIG. 2, illustrating the relationship of the conveyor blankets to the discharge end of the spreading frame.

As reflected in FIGS. 1 and 3, the discharge end of the spreader frame projects somewhat over the top of an endless lower conveyor blanket 26. The conveyor blanket 26 is supported at its opposite ends by transverse rollers 27, 28 which are supported by the frame structure 10 in such a way as to guide the upper reach of the conveyor blanket 26 substantially in the same plane as the spreader frame 16, but immediately below the latter. The arrangement is such that the discharge end of the spreader frame may rest lightly on the conveyor blanket 26.

The conveyor blanket 26 may be constructed of a fine mesh woven material of a hydrophobic nature. In general, however, metal mesh materials are unsatisfacatory because of their high heat conductivity. To great advantage, the conveyor belts may be constructed of a woven nylon mesh. In some cases, a highly perforated plastic web material may also serve adequately. The significant characteristics of the conveyor blanket 26 are nonabsorbency of moisture, relatively low heat conductivity and relatively high porosity to steam and air.

Underneath the upper reach of the conveyor blanket 26 is a steam box 29 having a perforated upper surface plate 30, flanges 31 and 32 of which may extend upstream and downstream from the side walls 33 of the steam box. The plate 30 and its flanges 31, 32 form a limited supporting surface for the conveyor blanket 26, as will be apparent in FIG. 3. As is also apparent in that Figure, the steam box is located somewhat downstream of the discharge end 34 of the spreader frame 16. The steam box is provided with an appropriate connection 35 to a steam supply. To advantage, the process provides for steam to be supplied to the steam box 29 at low pressure. The entire upper surface area of the steam box desirably is perforated to provide a substantial outlet area for the steam. Thus, the low pressure steam supplied to the steam box 29, escapes with a minimum velocity, enabling a highly efficient utilization of steam in the process.

Also located beneath the upper reach of the conveyor blanket 26, downstream of the steam box 29, is a suction box 36, connected to a source of vacuum 37. The upper surface plate 38 of the suction box is suitably slotted to provide for a relatively high velocity flow of air into the suction box. As reflected in FIG. 1, the top plate 38 of the suction box forms a suitable support for the conveyor blanket 26 such that air driven into the suction box passes through the upper reach of the conveyor blanket as well as through a sweater blank 23 carried thereby. The suction box functions to draw air through the sweater section and through the conveyor blanket at a sufficient velocity to cool and reduce residual moisture contained in the sweater blank and also to cool and greatly minimize or eliminate moisture on the surface of the hydrophobic conveyor blanket material.

Pursuant to the invention, a second conveyor blanket 39 is provided, typically of the same material as the lower conveyor blanket 26, and in any event of a material having characteristics of being nonabsorbent of water, a relatively low conductor of heat and a relatively high porosity. The second conveyor blanket 39 is positioned above the first, being trained about roller 40, 41. As reflected particularly in FIG. 1, the upper conveyor blanket 39 is substantially shorter in length than the lower conveyor blanket 26. In a typical embodiment of the invention, the lower conveyor blanket may extend several feet beyond the upper blanket at the downstream or discharge end of the apparatus, providing a zone in which the fabric is cooled and its moisture content reduced by the action of the suction box 36, while remaining supported on the conveyor blanket 26 and being free to relax.

As also reflected in FIG. 1, the downstream roller 41, about which the upper conveyor blanket 39 is trained, is positioned between the steam box 29 and the suction box 36. Desirably, the roller 41 is located above an area of the lower conveyor blanket 26 which is unsupported by an opposing roll or other means, such that materials passing under the roller 41 are protected against exposure to concentrated localized pressure. If it is found necessary to support the lower conveyor blanket 26 in the region of the roller 41, adequate spacing should be provided to avoid the application of concentrated pressures by the roller 41.

In accordance with one aspect of the invention, the spreader frame 16 is so positioned relative to the conveyor blankets 26, 39 that the discharge end of the spreader extends for at least a short distance between the conveyor blankets. For convenience, the entry end rollers 27, 40 for the respective conveyor blankets are offset with respect to each other, such that the lower conveyor blanket extends somewhat further in the upstream direction than the upper conveyor blanket. The vertical spacing between the axes of the rollers 27, 40 is such as to freely accommodate the presence of the spreader frame, and a section of tubular fabric being conveyed thereby, without causing an appreciable amount of rolling pressure to be applied to fabric passing over the spreader. In this respect, the discharge end of the spreader frame can rest lightly on the lower conveyor blanket, and the lower reach of the upper conveyor blanket may lightly contact fabric on the top side of the spreader frame, but concentrated pressures of any kind are to be avoided, to prevent pressue marking of sensitive fabrics.

With reference to FIG. 3, the apparatus of the invention includes a floating guide roll 42, which is positioned above the flange lip 31 of the steam box cover plate and is positioned to bear lightly upon the lower reach of the upper conveyor blanket 39. In the illustrated arrangement, the floating guide roll 42 is supported at its ends by a pair of arms 43, pivoted to the machine frame at 44 and providing for a generally vertical floating action of the guide roll. In addition, the guide roll 42 is adjustable in a manner to provide a degree of control over the time in which the fabric is free of the spreader frame 16, but not yet fully engaged and gripped by the conveyor blankets 26, 39. In the arrangement specifically illustrated, such adjustment is made in the direction of conveyor movement, as by means of adjusting screws 45 carried by the pivoted arms 43 and adjustably positioning guide roll bearings 46. The arrangement is such, according to the invention, that the spacing X (FIG. 3) between the discharge end 34 of the spreader and the floating guide roll 42 may be adjusted in accordance with the requirements of the process.

A second floating guide roll 47 is positioned above the downstream flange 32 of the steam box cover plate. In the illustrated arrangement, the guide roll 47 may be supported in vertically slotted brackets 48, for example, to provide for the desired freedom of vertical motion. The floating guide rolls 42, 47, in conjunction with the steam box cover plate 30, provide a short area in which the conveyor blankets 26, 39 are lightly urged together and held close to the perforated cover of the steam box. The weight of the guide rollers is desirably no greater than necessary to press the upper conveyor blanket 39 on to the fabric, so that the fabric is lightly gripped thereby, while avoiding concentrated pressures.

At an appropriate position along the upper or return reach of the upper conveyor blanket 39, there is provided a suction box 49 having a transversely extending slot 50 exposed to the bottom surface of the blanket. As the blanket passes over the suction box, a relatively strong flow of air into the slot 50 serves to remove surface moisture from the blanket and also to cool the blanket somewhat. In this connection, maintaining the conveyor blankets substantially free of surface moisture at the entry end is regarded as important, to prevent moistening of the fabric while it remains on the spreader frame. It is a significant aspect of this invention, that the fabric be retained in a substantially dry state until it has been discharged from the spreader.

In the illustrated arrangement, the spreader frame and conveyor blankets are driven through a variable speed mechanism 51 and drive motor 52. A first drive chain 53 connects the variable speed mechanism 51 with the drive shaft 22 for the spreader edge drive rolls 15, while a second drive chain 54 connects the variable speed mechanism with the roller 27 supporting the lower conveyor blanket. The roller 40, supporting the upper conveyor blanket, is connected to the roller 27 by a third chain 55, to provide for synchronized movement of the upper and lower conveyor blankets. By appropriate control of the speed of the motor 52 and of the variable speed mechanism 51, the over-all speed of the equipment may be controlled and also the speed of the spreader frame 16 may be varied relative to the speed of the conveyor blankets. In this respect, for certain fabrics it may be desirable to slightly overfeed or underfeed the fabric from the spreader frame into the conveyor blankets. Excess overfeeding of the fabric can result in undesirable wrinkling of the fabric, but this is readily observable by the machine operator, who can easily make correcting adjustments.

Located slightly upstream from the suction box 36, and downstream of the blanket roller 41, is a rotatable agitator bar 56, which is mounted for rotation closely underneath the upper reach of the lower conveyor blanket 26. The agitator bar 56 is driven by a motor 57 and chain 58 to rotate at relatively high speed. The bar is noncircular in cross-sectional configuration and thus, as it rotates, serves to repeatedly displace the conveyor blanket 26 upwardly with significant vertical amplitude. This introduces a strong and rapid cyclical vertical motion into the conveyor blanket, the effect of which is felt not only in the immediate region of the agitator bar 56, but also in the area of the steam box 29. This agitation induced by the bar 56 enhances and encourages relaxation of the sweater section during the steaming phase, as it passes over the steam box 29. It also encourages and enhances relaxation of the fabric during the cooling and drying phase, after it has been released by the upper conveyor blanket 39 and is supported only by the lower conveyor blanket 26. Thus, the vigorous agitation imparted by the bar 56, having a substantial verical amplitude, tends to lift the fabric off of the surface of the conveyor blanket, and thereby encourages relaxation of the fabric free of any frictional restraining action of the blanket 26.

With some fabrics and some conveyor blanket materials, there may be a tendency for the partially processed fabrics to adhere to the upper blanket as it commences its return about the roller 41. To counteract such tendency, it may be appropriate to utilize a roller 59 driven by a chain 60 from the high speed motor 57 and arranged to brush lightly against the conveyor blanket to free fabric tending to adhere thereto.

Sweater fabrics to be procesed according to the invention are conventionally connected together in the knitting operation by a removable draw string. For ease of handling, the sweater sections remain connected together in a web-like form throughout the various preliminary processing operations, up to and including washing and drying. Prior to processing according to the invention, however, the draw strings are removed, and the individual sections separated for individual processing. This is desired so that the shaping of the cuff section of one sweater blank will not be adversely affected by being connected to the body portion of an adjacent section. The individual sweater segments, in a substantially dry condition, having been dried after washing and remaining free of any special moisturizing operations, are applied one at a time to the upstream end of the spreading frame 16. It is an important feature of this invention, that the fabric remains in its substantially dry condition at all times while it is in contact with the spreader.

The amount of spreading applied by the frame 16 typically is relatively small. For example, the sweater fabric having a 28 inch circumference when delivered off of the knitting machine may have been reduced to a 23–24 inch circumference as a result of the various previous previous processing operations, including washing and drying. Typically, such fabric may have desired circumference in the range 25–26 inches, in which case the spreader 16 would be set to distend the sweater sections to dimensions slightly larger than the desired circumference, providing for some amount of relaxation of the fabric to its desired circumference.

As the knitted sweater sections pass over the spreader, the entire sweater section, including the cuff portion as well as the body portion, is distended to a uniform width, as determined by the adjusted setting of the spreader. As the fabric is discharged from the spreader, it is momentarily unrestricted and therefore allowed to relax and contract laterally. The amount of such contraction may be controlled, within limits, by adjustment of the positioning of the first floating guide roller 42. In the illustrated apparatus, this adjustment is made in the upstream or downstream direction. The optimum such adjustment is determined empirically with respect to a given article being processed. Generally, the adjustment is such that the cuff portion of the sweater section will differentially contract to its desired circumference, which is somewhat less than the desired circumference of the body portion of the sweater. Generally, the spacing should not be substantially greater than necessary to accomplish the foregoing objective, in order to retain maximum geometric control of the body portion of the sweater section.

After passing under the floating guide roll 42, the entire sweater body is lightly gripped and confined between the synchronously moving upper and lower conveyor blankets 39, 26, throughout the interval of travel between the spaced floating guide rolls 42, 47. While thus lightly gripped, the fabric is steamed, to effect moisturizing and lubricating of the fibers, and to accommodate relaxation of the stitches. During this steaming phase, the sweater section may be subject to agitation transmitted to it from the lower conveyor belt 26, from the agitator bar 56. This encourages and enhances relaxation of the fabric structure, even though the sweater is lightly held by the conveyor blankets.

Shortly after the steaming phase, the sweater section emerges from underneath the relatively short upper conveyor blanket 39 and is separated from the upper blanket, if necessary, by the action of the rotating brush 59. The sweater then continues to be supported across its full width and conveyed by the lower conveyor blanket 26, passing directly over the agitator bar 56, which vigorously agitates the blanket and the sweater section with substantial vertical amplitude. In this region, since the sweater section is not restrained by the upper blanket, it can be lifted free of the lower blanket, and further relaxation is encouraged.

With continued movement of the conveyor blanket 26, the fabric section passes over the suction box 36, and the resulting relatively high velocity flow of air through the fabric section and conveyor blanket into the suction box serves to cool both the sweater and the conveyor blanket and to remove moisture therefrom. The fabric then continues to be conveyed by the blanket 26 to the discharge end of the apparatus, where it is removed manually or otherwise.

A unique feature of the above described procedure for the processing of sweater sections is the fact that the cuff portion is fully steamed along with the body section. Significantly, however, the "framing" stage of the processing is carried to completion and is discontinued while the fabric remains in a substantially dry condition, so that the highly elastic cuff section differentially contracts substantially to its desired dimension prior to the application of steam. Pursuant to the invention, although the fabric is not engaged by the framing elements (the spreader 16) during the steaming phase, it is kept under substantial geometric control during that phase, by means of the light gripping action of the opposed conveyor belts 26, 39.

The ability to pass the entire sweater blank over the spreader frame 16 is in part enabled by the fact that the fabric comes into the process in a substantially dry condition and in part by the fact that both conveyor blankets are dried after being exposed to steam, so they do not bring moisture of condensation back into contact with the fabric while it is in contact with the spreader frame.

It should be understood, of course, that the specific form of the invention herein illustrated and described are intended to be representative only, as certain changes may be made therein without departing from the clear teachings of the disclosure. Accordingly, reference should be made to the following appended claims in determining the full scope of the invention.

I claim:

1. The method of processing tubular knitted sweater sections or the like having integrally connected body and cuff portions which comprises, a. delivering disconnected, individual sweater sections one at a time, in succession, in substantially dry condition, b. successively engaging each section by internal edge portions and simultaneously advancing and laterally distending each section by its said edges to a predetermined uniform width, c. maintaining the section free of externally applied moisture, during lateral distention of the section, d. successively discharging the distended sweater section onto endless supporting surfaces while disengaging said edge portions to accommodate differential lateral relaxation of the body and cuff portions of the sweater section.

e. grippingly engaging, supporting and conveying both faces of the disengaged section, f. controlling the differential lateral relaxation of the sweater section by controlling the interval between the discharge of the distended section and the gripping engagement, support and conveying of both faces thereof, g. thereafter steaming the differentially relaxed section over its entire area while engaged between said supporting surfaces, including the cuff, to accommodate further relaxation and adjustment and h. removing residual moisture from said supporting surfaces prior to engagement of the sweater section thereby.

2. The method of claim 1, further characterized by a. subjecting each sweater section to vibratory agitation subsequent to said steaming step, b. the sweater section being supported only by its lower face during at least a portion of the vibratory agitation thereof, and c. said vibratory agitation having a sufficient vertical component to lift the sweater section off of the supporting surface therefor.

3. The method of claim 1, further characterized by a. causing a flow of cooling and drying air through said sweater section subsequent to said steaming step.

4. The method of claim 1, further characterized by a. commencing gripping engagement of both faces of the sweater section across its full width substantially immediately following said lateral relaxation, b. maintaining said engagement throughout said steaming step and for at least a short interval thereafter, and c. therafter releasing said gripping engagement while continuing to support the section across the full width thereof and to convey the section.

5. The method of claim 4, further characterized by a. subjecting the sweater section to vibratory agitation during said steaming step, b. continuing said agitation subsequent to release of said gripping engagement while the section continues to be supported by its lower face and conveyed, and c. said vibratory agitation having a sufficient vertical component to lift the sweater section off of the supporting surface therefor.

6. The method of processing tubular knitted sweater sections or the like having integrally connected body and cuff portions, which comprises a. delivering disconnected, individual sweater sections one at a time, in succession, in substantially dry condition, b. progressively distending each sweater section laterally to a flat form and to predetermined uniform width, by engagement of the section internally by its edges while advancing the section longitudinally, c. progressively disengaging and discharging the edges of the section and accommodating differential lateral relaxation of the body and cuff portions thereof, d. maintaining each portion of the sweater section free of externally applied moisture during lateral distention of the section, e. thereafter, progressively grippingly engaging the sweater section lightly over its upper and lower faces and over a substantial longitudinal extent thereof by endless supporting surfaces and continuing to progressively advance the section, f. controlling the differential lateral relaxation of the sweater section by controlling the interval between the discharge of the distended section and the gripping engagement, support and conveying of both faces thereof, g. steaming the sweater section over its entire area while engaged between said supporting surfaces by progressively steaming the section in areas thus lightly gripped, h. progressively releasing the steamed section and continuing to advance the section while supporting its lower face across the full width, i. drying and cooling said section while continuing to support its lower face across the full width, and j. removing residual moisture from said supporting surfaces prior to engagement of the sweater section thereby.

7. The method of claim 6, further characterized by a. maintaining each sweater section free of concentrated, localized pressures, at least during and subsequent to said steaming step.

8. The method of claim 6, further characterized by a. initially lightly engaging each sweater section by said endless supporting surfaces while being distended.

9. The method of claim 8, further characterized by a. at least one of said endless supporting surfaces being exposed to vacuum.

10. The method of processing tubular knitted sweater sections or the like having integrally connected body and cuff portions, which comprises a. delivering disconnected, individual sweater sections one at a time, in succession, in substantially dry condition, b. progressively distending each sweater section laterally to a flat form and to predetermined uniform width, by engagement of the section internally by its edges while advancing the section longitudinally, c. progressively discontinuing lateral distention of the sweater section to accommodate progressive differential lateral relaxation of the sweater section, d. maintaining distended portions of the sweater section free of externally applied moisture, e. thereafter lightly engaging and gripping both faces of the sweater blank by endless supporting surfaces, f. controlled lateral relaxation of the sweater section occurring in the interval between the discharge of the distended section from the flat form and the engagement of such section by the endless supporting surfaces, g. thereafter steaming the sweater section over its entire area while engaged between said supporting surface and while said section remains in a differentially laterally relaxed condition, and h. removing residual moisture from said supporting surfaces prior to engagement of the sweater section thereby.

11. The method of claim 10, further characterized by a. supporting the steamed sweater section on its lower face only, b. agitating the steamed section with sufficient vertical amplitude to lift the steamed section off of its supporting surface, and c. thereafter cooling and drying the agitated sweater section.

12. The method of claim 10, further characterized by a. uninterruptedly engaging the internal edges of said sweater section during the distending step.

* * * * *